United States Patent [19]

Muench et al.

[11] Patent Number: 4,628,292

[45] Date of Patent: Dec. 9, 1986

[54] UNDER OIL EXPULSION FUSE CARTRIDGE ASSEMBLY

[75] Inventors: Frank J. Muench, Waukesha; Gordon T. Borck, Cudahy, both of Wis.

[73] Assignee: RTE Corporation, Waukesha, Wis.

[21] Appl. No.: 748,266

[22] Filed: Jun. 24, 1985

[51] Int. Cl.[4] ..... H01H 85/02; H01H 85/14

[52] U.S. Cl. ..... 337/204; 337/203; 337/217; 337/250

[58] Field of Search ..... 337/204, 203, 217, 249, 337/250, 277-282

[56] References Cited

U.S. PATENT DOCUMENTS 4,205,295 5/1980 Nahieu ..... 337/203

*Primary Examiner*—Harold Broome

[57] ABSTRACT

An under oil expulsion fuse cartridge assembly includes a tubular housing of non-electrical conductive material, an electrically conductive contact removably threadedly mounted on each end of the housing, and a replaceable fuse assembly removably received within the tubular housing. One of the end contacts incorporates a pressure chamber providing a flushing and cleaning operation during the interruption process. The fuse assembly includes a fuse liner tube in a fuse link therein in the form of a flat ribbon element electrially connected to each of the end contacts. One end of the fuse link is mounted on a thin disc which includes a plurality of projecting lands that prevent direct engagement of the fuse link with the end contact to avoid breaking the fuse link. The fuse link also includes a plurality of holes formed therethrough covered by a eutectic material having a desired melting temperature so that current interruption occurs at a predetermined operating temperature.

19 Claims, 7 Drawing Figures

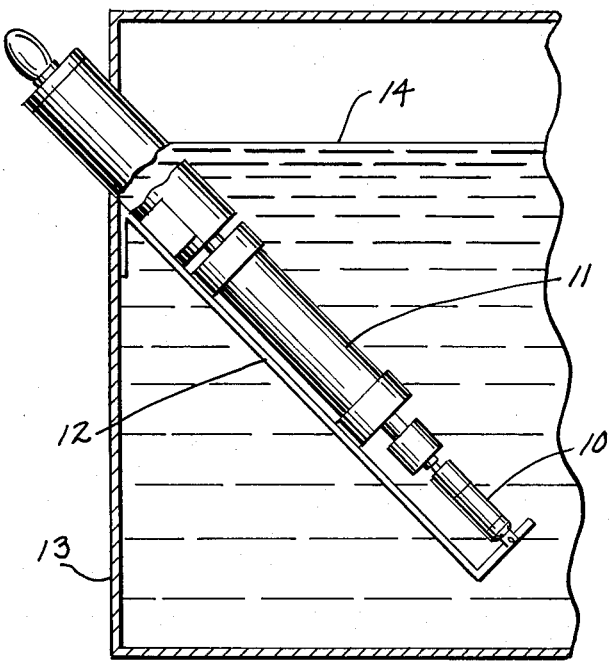
FIG. 1
FIG. 2
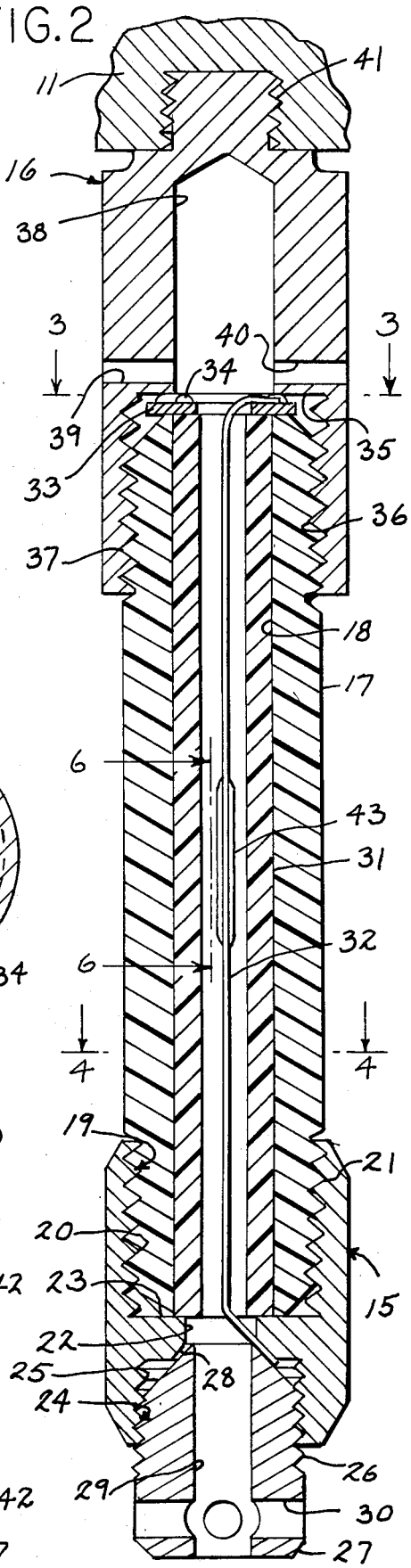
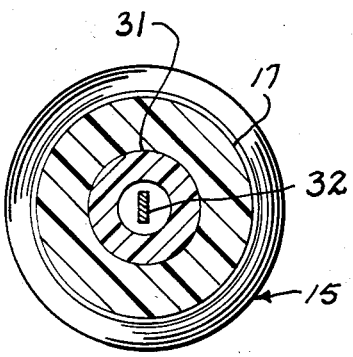
FIG. 4
FIG. 3
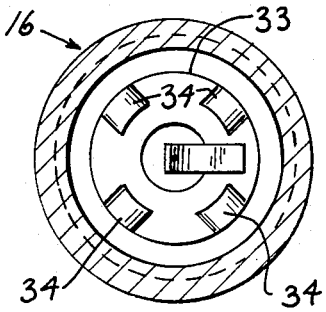
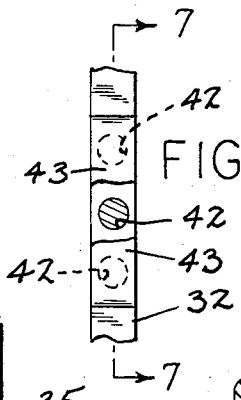
FIG. 6
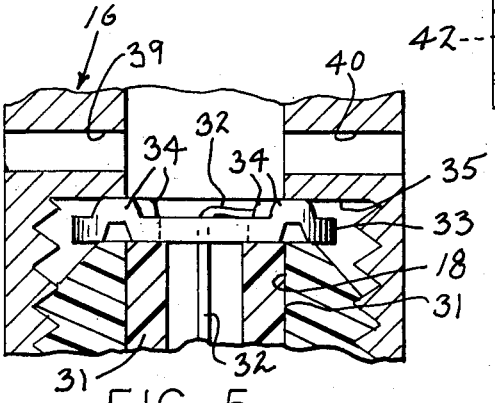
FIG. 5
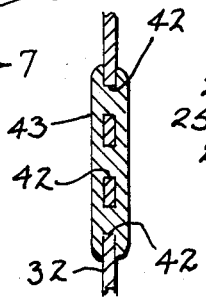
FIG. 7

UNDER OIL EXPULSION FUSE CARTRIDGE ASSEMBLY

BACKGROUND OF THE INVENTION

The present invention relates to fuses, and more particularly to an under oil expulsion fuse cartridge assembly.

Under oil expulsion fuses are generally used in high voltage systems to protect the electrical devices from fault currents. An expulsion fuse can be used by itself or in tandem with backup current limiting fuses since it can be used to provide current interruption under low fault conditions without operation of the more costly limiting fuse.

State of the art expulsion fuse cartridges are typically manufactured by assemblying two brass end contacts such that their projecting annular lips surround opposite ends of a molded nylon sleeve, winding a glass filament epoxy strengthening layer over the nylon sleeve and projecting lips, and then coating the epoxy layer with an arc extinguishing material such as polyester until the outer surface of the polyester is flush with the outer surface of the brass end contacts. A replaceable fuse assembly is inserted within the sleeve and is held in position by a pair of clamping nuts threaded into the outer ends of the two end contacts.

One problem with such an assembly is that when the clamping nuts are turned down into the end contacts to engage the ends of the fuse link they may break the fuse link due to the applied forces. It is therefore desirable to provide means for preventing direct contact or engagement of the clamping nut with the end of the fuse link and yet maintain adequate electrical contact therewith. It has also been found desirable to provide a fuse link which will open during overload conditions at a predetermined temperature and location.

SUMMARY OF THE INVENTION

An under oil expulsion fuse cartridge assembly capable of providing electrical isolation following its operation. The assembly includes a tubular housing of non-electrical conductive material having a bore extending longitudinally therethrough, an electrically conductive contact member mounted on each end of the housing, a fuse liner tube removably receivable within the bore of the housing having an opening extending longitudinally therethrough, and a fuse link removably receivable within the opening of the fuse liner tube.

In one aspect of the invention, the assembly includes mounting means for mounting one end of the fuse link which includes spacer means engageable with one of the end contact members to prevent direct contact or engagement of the fuse link with the end contact member. In order to accomplish this, the mounting means is in the form of a thin disc or washer and the spacer means includes at least one raised landing or projection on one face of the disc. Preferably, a plurality of landings are circumferentially spaced on the disc and the fuse link is attached therebetween so that when the end contact is threaded onto the cartridge housing it engages the landings and not the fuse link. This allows electrical connection between the fuse link and the end contact without adding any mechanical stress on the fuse link thus reducing the likelihood of breaking the fuse link.

In another aspect of the invention, the fuse link includes current interrupting means located intermediate its ends for interrupting current flow therethrough in response to a predetermined operating temperature. Thus, the fuse link element is designed to open at a predetermined temperature and location during overload operation. In order to accomplish this, the fuse link includes at least one hole formed therethrough covered with a utectic material having a desired melting temperature. When a predetermined operating temperature is reached, the utectic material will soften and flow away from the holes causing a reduced cross section in the fuse link which in turn causes the fuse link to open at this point, burn back, and interrupt the circuit. Preferably, the fuse link is in the form of a thin ribbon so that during high current fault conditions the element will operate as a solid conductor, maintaining a specific cross section by disregarding the utectic material to provide for proper coordination with a current limiting fuse if used in such a manner. The flat ribbon fuse link may be designed with a specific cross section having a desired thickness and width, and by varying this cross section the fuse link may be utilized to regulate the oil flow within the assembly to provide various desired specific melting characteristics. When the interrupting operation is completed, the present design allows oil to reflow back through the fuse liner tube and provide the dielectric medium to isolate the circuit until refusing may be accomplished.

In another aspect of the invention, one of the end contacts is designed as a pressure vessel which incorporates a pressure chamber therein. This pressure chamber assists current interruption by storing the pressure developed during the build up of gases generated during arcing, and following this build up, the pressure will force the gases through vent holes in the vessel and also back through the fuse link liner tube providing a flushing and cleaning operation for the bore thereof.

The present invention thus provides and expulsion fuse cartridge assembly which forms a current interrupting device capable of providing electrical isolation following its operation by providing a fuse link element designed to open at a predetermined temperature and location and an end contact that provides a flushing and cleaning operation. The assembly also provides a mechanism for mounting the fuse element so as to reduce the likelihood of breakage during assembly.

BRIEF DESCRIPTION OF THE DRAWINGS

The drawing illustrates the best mode presently contemplated of carrying out the invention.

In the drawings:

FIG. 1 is a side view in elevation with parts broken away illustrating a holder incorporating an expulsion fuse in accordance with the principles of the present invention;

FIG. 2 is a cross sectional side view in elevation illustrating an expulsion fuse in accordance with the principles of the present invention;

FIG. 3 is a cross sectional view taken along the plane of the line 3—3 in FIG. 2;

FIG. 4 is a cross sectional view taken along the plane of the line 4—4 in FIG. 2;

FIG. 5 is a fragmentary detailed view illustrating the mounting of one end of the fuse link;

FIG. 6 is a fragmentary detailed view of the fuse link taken along the plane of the line 6—6 in FIG. 2; and FIG. 7 is a fragmentary cross sectional view taken along the plane of the line 7—7 in FIG. 6.

DESCRIPTION OF THE PREFERRED EMBODIMENT

An expulsion fuse 10 may be used alone, or in tandem with a current limiting fuse 11, as illustrated in FIGS. 1 and 2. In the latter case, fuses 10 and 11 are mounted on a support fixture 12 to hold their positions as required for proper operation. As shown in FIG. 1, the combined fuses 10 and 11 as well as mounting fixture 12 are generally installed in an enclosure 13 filled with an insulating fluid 14 such as oil to insulate and cool the enclosed electrical apparatus. As an alternative to fixture 12, fuses 10 and 11 may be held by a bayonet type fixture (not shown) of conventional construction.

Expulsion fuse 10 includes a pair of contacts 15 and 16 threadedly secured to the opposite ends of an insulated tubular housing 17. Each end contact 15 and 16 includes a cylindrical body having an outer diameter greater than that of the outer diameter of housing 17. End contacts 15 and 16 are preferably composed of brass and include a smooth outer surface which serves as a sliding surface upon which external contacts to the fuse can slide. In contrast to end contacts 15, 16, housing 17 is composed of an insulating material having sufficient impact strength to withstand the forces developed during a fusing operation. The material employed for housing 17 is preferably a moldable plastic compound such as glass filled polyester or glass filled epoxy. Housing 17 includes a bore 18 formed longitudinally therethrough for accepting a replaceable fuse assembly hereinafter to be described.

As shown in FIG. 2, the tubular assembly of fuse 10 includes a threaded connection between end contacts 15, 16 and housing 17. End contact 15 includes a central opening formed therethrough having a first portion 19 having internal threads 20 formed in end contact 15 for threadedly engaging external threads 21 formed on the end of housing 17. The opening through end contact 15 further includes a second portion 22 of a reduced diameter which is less than the diameter of portion 19. First portion 19 and second portion 22 define an annular radially extending abutment surface 23 therebetween that engages the end of housing 17 when end contact 15 is threaded thereon so that contact 15 may be securely tightened on the end of housing 17. The inner surface of portion 22 is smooth and its diameter is sized so that both housing 17 and the liner tube for the replaceable fuse assembly engages abutment surface 23 to properly locate and align these elements.

The opening in end contact 15 also includes a third portion 24 having a diameter greater than that of second portion 22. Third portion 24 has internal threads 25 formed in end contact 15 for threadedly engaging external threads 26 on the end of a clamping nut 27, the purpose of which will hereinafter be described. A tapered annular surface 28 extends in a diverging manner from second portion 22 to third portion 24. Surface 28 is formed at an angle so as to reduce the mechanical stress applied on the end of the fuse link so as to reduce the likelihood of breakage thereof during assembly.

Clamping nut 27 includes a first bore 29 formed longitudinally therethrough which is coaxial with bore 18 when nut 27 is assembled or threaded on end contact 15. Nut 27 also includes a second bore 30 extending transversely to bore 29 at its outer end. Bores 29 and 30 communicate with the outer surface of nut 27 so as to permit the fusing operation to occur in a conventional manner. Nut 27 also includes a cone shaped inner end 31 which is tapered at an angle that substantially corresponds to the angle of surface 28 so as to limit the mechanical stress applied on the fuse link.

A replaceable fuse assembly is located in bore 18 of housing 17. The fuse assembly includes a fuse liner tube 31 composed of an insulating material such as a synthetic fluorine containing resin like "Teflon", a horn fiber available from the Spaulding Fiber Co., or other arc abladed material having both good dielectric and interrupting characteristics. Fuse tube 31 serves several functions. First, it provides a non-conductive insulating bore that gives off arc extinguishing gas during the fusing operation. Tube 31 also absorbs much of the shock wave and pressure produced when the fuse link explodes and burns back during fusing, and transmits a more uniform force to housing 17. A major function of fuse tube 31 is to admit, trap and contain some of the high energy parts from the fusing of the link element. These products consist of molten fuse link bits, solids and gases caused by the vaporization of the fuse link element and insulating oil 14 in the fuse tube bore.

The fuse assembly also includes an expulsion fuse link 32 which will begin fusing according to a predetermined fuse melt characteristic. Fuse link 32 is in the form of a flat thin ribbon composed of any suitable conductive material such as silver, and is removably receivable within the bore or opening of fuse liner tube 31 so that its opposite ends project from the opposite ends of tube 31. One end of link 32 is secured to end contact 15 by means of clamping nut 27, as shown in FIG. 2, while the other end of link 32 is secured to end contact 16 by means of a thin disc or washer 33. As shown best in FIG. 3, link 32 is secured, as by welding, to one face of disc 33. Link 32 is secured in a position located between two adjacent landings or projections 34. As shown best in FIG. 3, there are four landings 34 equiangularly spaced apart from one another circumferentially about one side of disc 33. Landings 34 project axially from disc 33 a sufficient distance to prevent contact or engagement of end contact 16 with fuse link 32 so that no added mechanical stress is placed on link 32 during assembly thus reducing the likelihood of breakage of link 32. Disc 33 is composed of brass or a similar electrically conductive material so that contact of landings 34 with end contact 16 creates the electrical connection necessary between fuse link 32 and end contact 16. As shown in FIGS. 2 and 5, disc 33 is located at a position where it is sandwiched between the ends of housing 17 and tube 31 and a radially extending annular shoulder 35 formed within end contact 16. Thus, when end contact 16 is assembled on housing 17 shoulder 35 engages landings 34 instead of the end of fuse link 32 and secures tube 31 and fuse link 31 in position within housing 17.

End contact 16 includes an opening formed longitudinally therein having a first portion having internal threads 36 formed in end contact 16 for threadedly engaging external threads 37 formed on the end of housing 17. This first portion cummunicates with a second portion or pressure chamber 38 of reduced diameter. The reduction in diameter of pressure chamber 38 results in the formation of annular shoulder 35. Vent holes 39 and 40 communicate from the exterior surface of end contact 16 to chamber 38. Pressure chamber 38 is dimensioned to have a volume and size for assisting in the current interruption by storing pressure developed by the build-up of gases generated during arcing of fuse link 32. Following the build up of pressure, gases will be forced through vent holes 39 and 40 and also backed through the bore in fuse liner tube 31 to provide a flushing and cleaning operation of the bore. This flushing and cleaning may be accomplished since bores 29 and 30 and clamping nut 27 provide proper venting of the molten vapor materials and gases following the interruption process. End contact 16 also include a threaded upper end 41 for connection to current limiting fuse 11.

Referring now to FIGS. 6 and 7, there is shown a current interrupting means located intermediate the opposite ends of fuse link 32 for interrupting current flow therethrough in response to a predetermined operating temperature. As illustrated, this current interrupting means includes three holes 42 formed through fuse link 32 covered with a utetic material 43 having a desired melting temperature. It should be noted that the utetic material 43 completely bridges and covers both sides of holes 42 so that during high current fault conditions fuse link 32 will operate as a solid conductor, maintaining its specific cross section and disregarding the utetic material 43, thus providing for proper coordination with current limiting fuse 11 if used in such a manner. The utectic material 43 may comprise numerous utectic solder alloys commonly known by those skilled in the art each having its own specific melting temperature. Thus, under overload conditions, when a predetermined operating temperature is reached, the utectic material 43 will soften, flow away from holes 42, resulting a reduced cross section in fuse link 32 which in turn causes fuse link 32 to open at its center, burn back, and interrupt the circuit. When the interrupting action is completed, this design will allow oil 14 to reflow back through fuse liner tube 31 and provide the dielectric medium to isolate the circuit until refusing may be accomplished. It should also be noted that since fuse link 32 is in the form of a flat ribbon its cross sectional area may be varied so that when placed in the bore of fuse liner tube 31 it can regulate the oil flow therethrough to provide specific melting characteristics. In other words, if the cross section of fuse link 32 is large, oil movement through the bore of tube 31 is relatively slow and therefore link 32 will open sooner at a lower current value. On the other hand, if the cross section of fuse link 32 is relatively small, oil movement through the bore of tube 31 will be relatively faster and therefore fuse link 34 will open later at a higher current value.

An under oil expulsion fuse cartridge assembly has been illustrated and described which includes an end contact 16 designed as a pressure vessel for providing a flushing and cleaning up operation during an interrupting operation. The assembly also includes a fuse link 32 designed to open at a predetermined temperature and location during overload operation, and which is mounted in a specific manner to eliminate mechanical stress thereon to reduce the likelihood of breakage during assembly.

Various modes of carrying out the invention are contemplated as being within the scope of the following claims particularly pointing out and distinctly claiming the subject matter which is regarded as the invention.

We claim:

1. An under-oil expulsion fuse cartridge assembly, comprising:

a tubular housing of non-electrical conductive material having a bore extending longitudinally therethrough;

an electrically conductive contact member mounted on each end of said housing;

a fuse liner tube removably receivable within the bore of said housing, and having an opening extending longitudinally therethrough;

a fuse link removably receivable within the opening of said fuse liner tube;

mounting means for mounting one end of said fuse link, said mounting means including spacer means engageable with one of said end contact members to prevent direct contact of said one end of said fuse link with said one end contact member; and clamping means for clamping the other end of said fuse link in engagement with the other end contact member.

2. The assembly of claim 1, wherein said mounting means is positionable between said one end contact member and said housing.

3. The assembly of claim 1, wherein said one end contact member is threadedly engageable on one end of said housing, and includes a radially extending annular shoulder projecting inwardly from said threaded connection engageable with said spacer means.

4. The assembly of claim 3, wherein said mounting means includes a thin disk positionable between said annular shoulder and said housing.

5. The assembly of claim 4, wherein said spacer means includes at least one landing projecting axially from one face of said disk.

6. The assembly of claim 5, wherein there are a plurality of landings circumferentially spaced on said one side of said disk.

7. The assembly of claim 5, wherein said fuse link comprises a flat ribbon joined to said disk on said one side thereof.

8. An under-oil expulsion fuse cartridge assembly, comprising:

a tubular housing of non-electrical conductive material having a bore extending longitudinally therethrough;

an electrically conductive contact member mounted on each end of said housing;

a replaceable fuse assembly removably receivable within the bore of said housing, said fuse assembly including a fuse liner tube having an opening extending longitudinally therethrough and a fuse link removably receivable within the opening of said fuse liner tube and having opposite ends electrically connected to respective end contact members, said fuse link including current interrupting means located intermediate its opposite ends for interrupting current flow therethrough in response to a predetermined operating temperature; and mounting means for mounting one end of said fuse link, said mounting means including spacer means engageable with one of said end contact members to prevent direct contact of said one end of said fuse link with said one end contact member.

9. The assembly of claim 8, wherein said current interrupting means includes at least one hole formed through said fuse link covered with a eutectic material having a desired melting temperature.

10. The assembly of claim 9, wherein said fuse link is in the form of a thin ribbon.

11. The assembly of claim 9, wherein said eutectic material bridges and covers both sides of said hole.

12. The assembly of claim 8, further including clamping means for clamping the other end of said fuse link in engagement with the other end contact member.

13. The assembly of claim 12, wherein said mounting means is positionable between said one end contact member and said housing.

14. The assembly of claim 12, wherein said one end contact member is threadedly engageable on one end of said housing, and includes a radially extending annular shoulder projecting inwardly from said threaded connection engageable with said spacer means.

15. The assembly of claim 14, wherein said mounting means includes a thin disk positionable between said annular shoulder and said housing.

16. The assembly of claim 15, wherein said spacer means includes at least one landing projecting axially from one side of said disk.

17. The assembly of claim 16, wherein there are a plurality of landings circumferentially spaced on said one side of said disk.

18. The assembly of claim 16, wherein said fuse link comprises a flat ribbon joined to said disk on said one side thereof.

19. The assembly of claim 8, wherein one of said end contact members includes an integral pressure chamber in communication with the opening in said fuse liner tube.

* * * * *